United States Patent [19]

Silver et al.

[11] 4,315,570

[45] Feb. 16, 1982

[54] TWO-COMPARTMENT CONTAINER WITH MEANS FOR DISPERSING CONTENTS OF ONE COMPARTMENT INTO THE OTHER COMPARTMENT

[76] Inventors: Jules Silver, Box 1188, Norwich, Conn. 06360; Thomas J. Vaiciulis, East Woodstock, Conn. 06244

[21] Appl. No.: 107,165

[22] Filed: Dec. 26, 1979

Related U.S. Application Data

[63] Continuation-in-part of Ser. No. 919, Jan. 4, 1979, abandoned.

[51] Int. Cl.[3] ..... B65D 25/08

[52] U.S. Cl. ..... 206/221; 215/DIG. 8; 128/272

[58] Field of Search ..... 206/221, 220, 219; 215/DIG. 8; 128/272

[56] References Cited

U.S. PATENT DOCUMENTS

| | | | |
|---|---|---|---|
| 2,764,157 | 9/1956 | Oliva et al. | 206/221 |
| 2,773,591 | 12/1956 | Jensen | 206/220 |
| 2,793,776 | 5/1957 | Lipari | 215/DIG. 8 |
| 2,813,649 | 11/1957 | Lipari | 206/221 |
| 3,070,094 | 12/1962 | Sarnoff et al. | 206/221 |
| 3,156,369 | 11/1964 | Bowes et al. | 215/DIG. 8 |
| 3,715,189 | 1/1973 | Nighohossian et al. | 206/219 |
| 3,840,136 | 10/1974 | Lan Franconi et al. | 215/DIG. 8 |

FOREIGN PATENT DOCUMENTS

| | | | |
|---|---|---|---|
| 638326 | 4/1962 | Italy | 206/219 |

*Primary Examiner*—Joseph M. Moy
*Attorney, Agent, or Firm*—Murray & Whisenhunt

[57] ABSTRACT

There is provided a two-compartment container. A lower mixing compartment has a closure which seals that compartment, and the upper end of an upper compartment is disposed in the closure and communicates through the closure to an aperture therein. A lower slideable seal in the lower end of the upper compartment effects a seal between the two compartments. That seal is exitable from the upper compartment by means of a digitally powered linking means projecting from the aperture, whereby the contents of the upper compartment are dispersed into the contents of the lower compartment. The lower seal quickly exits from the upper compartment and the contents impinge upon the lower seal and deflect therefrom to more uniformly disperse into the lower compartment.

14 Claims, 10 Drawing Figures

TWO-COMPARTMENT CONTAINER WITH MEANS FOR DISPERSING CONTENTS OF ONE COMPARTMENT INTO THE OTHER COMPARTMENT

REFERENCE TO RELATED APPLICATIONS

This application is a continuation-in-part of application Ser. No. 919, filed Jan. 4, 1979 now abandoned.

The present invention relates to a two-compartment container and more particularly to such containers where the contents of the upper compartment are manually dispersed into the contents of the lower compartment for mixing purposes. Even more particularly, the present invention relates to such containers which are of the non-pressurized class.

BACKGROUND AND PRIOR ART STATEMENT

In certain commercial packagings, it is necessary for two components of the packaged material to remain physically separated until just prior to use. This requirement is a result of a variety of constraints placed upon the packaged material because of its particular nature. For example, the two components may be required for adequate utility of the packaged material, but once mixed the two components or one of the components may rapidly deteriorate and destroy that required utility. An example of this is where a medicine must be administered in a solution, but the solution is not stable under ambient conditions. On the other hand, the two components may require separate packaging because of a reaction which takes place when the two components are mixed and the mixture must be used either during or shortly after the reaction takes place. An example of this is where the components when mixed foam and the mixed components must be used in a foamed condition. Other examples of such constraints placed on the packaged materials are well known to the art.

To provide containers of the foregoing nature, the art has proposed a variety of container constructions where some positive movement of an element of the container will allow the two components to mix. One approach in the art is that of providing special cooperating configurations of a moveable element and the container per se, such that a "valving" action is provided between that element and the container. This arrangement, however, requires special containers and does not lend itself to broad commercial application. The special containers not only substantially increase the cost of the package but are not handleable on conventional packaging machines. Also, in this approach of the art, the moveable element is often left in the container which is most unsatisfactory for certain applications, particularly where the entire contents are to be emptied and used. The movable element in the container constitutes a foreign object and the presence thereof is often both asthetically and functionally objectionable. U.S. Pat. No. 2,869,745, U.S. Pat. No. 3,464,714, U.S. Pat. No. 3,809,225, and U.S. Pat. No. 3,842,836 are representative of this art.

In a similar approach, the art has proposed telescoping upper and lower vessels for forming the two compartments with a displaceable plug in at least one of the compartments. Here again, special container configurations are required, at least on one of the vessels, and the displaceable plug is normally left in the mixed components. U.S. Pat. No. 3,314,563 is representative of this art.

The art has proposed other arrangements which may utilize more conventional lower containers, but require very special upper containers through which an action displaces a sealing plug between the two compartments and the package. Here again, the plug remains in the mixed components and is unacceptable for the reasons noted above. U.S. Pat. Nos. 2,524,607, 2,653,611, 2,781,141, 3,326,400, 3,493,823 and 3,539,794 are representative of this approach.

Valving mechanisms which do not require special lower containers have also been proposed, but these valving mechanisms have not been totally satisfactory. For example, in one such approach, the total valving mechanism communicates with the mixing components, as illustrated in U.S. Pat. No. 2,764,157. The removal of the contents of the package is difficult at best and that arrangement is useful only in very special cases. U.S. Pat. No. 2,793,776 proposes an alternate arrangement where a threaded device operates through a rod to move a plug from an upper container disposed in a lower container to discharge the contents from the upper container. This arrangement is not only relatively expensive to manufacture, but has the disadvantage that slowly opening the plug from the upper container only gradually allows the contents of the upper container to flow therefrom. When the contents of the upper container are subject to agglomeration on contact with the contents of the lower container, this slow opening can cause initial contact between the contents of the lower container and the upper container in such a gradual manner that agglomeration will occur and prevent the contents of the upper container from fully emptying even after the plug of the upper container is fully removed. This gradual dispensing of the contents of the upper container also fails to dispense the contents of the upper container uniformly throughout the contents of the lower container and this can cause difficulties in subsequent mixing.

In a variation of the foregoing arrangement, U.S. Pat. No. 3,924,741 proposes a slideable gate arrangement where an inside sleeve covers apertures in an outside sleeve and, by moving the inside sleeve upwardly, the apertures allow the contents of the upper container to flow therethrough. Here again, this results in a gradual release of the contents of the upper container in the manner discussed above in connection with U.S. Pat. No. 2,793,776 and suffers from the same disadvantages.

Finally, another approach in the art has been to provide a pierceable diaphram separating the two compartments of a two component package. However, this arrangement requires most careful manufacture of the diaphram, since if the diaphram is accidentially ruptured during handling, the package will be rendered useless. On the other hand, if the diaphram provides sufficient insurance to avoid accidental rupture, it may be difficult to rupture the diaphram when mixing is desired. Diaphram packages, therefore, have not been widely accepted in the art.

Under the circumstances, it would be of significant advantage in the art to provide a two component container where mixing of the two components can be more uniformly carried out and where agglomeration and the like of one component when dispersed in the other component is avoided. It would be further advantageous to the art to provide such containers where the likelihood of caking, and preventing full discharge of the contents of the upper compartment is essentially avoided.

OBJECTS OF THE INVENTION

Therefore, it is an object of the invention to provide a two-compartment container which is adapted for more uniformly dispersing the contents of an upper compartment into the contents of the lower mixing compartment. It is a further object of the invention to provide such a container where the contents of the upper compartment are rapidly dispersed into the contents of the lower compartment and, essentially, avoid caking, balling and like agglomeration. It is a further object of the invention to provide such container which is simple to manufacture and where the contents of the lower compartment may be filled in conventional automatic packaging machinery. It is yet another object of the invention to provide such containers which can handle a variety of components to be mixed, including those components which when mixed create a foam or otherwise liberate a gas. It is another object of the invention to provide such two-compartment container where parts of the container are not ultimately displaced into the mixed components, and thus the present invention avoids the athestically objectionable practices of prior art containers. Finally, it is an object of the invention to provide containers which are filled with special components for mixing, including those components which form a gas when mixed. Other objects will be apparent from the following disclosure and claims.

BRIEF DESCRIPTION OF THE INVENTION

Figure 1:
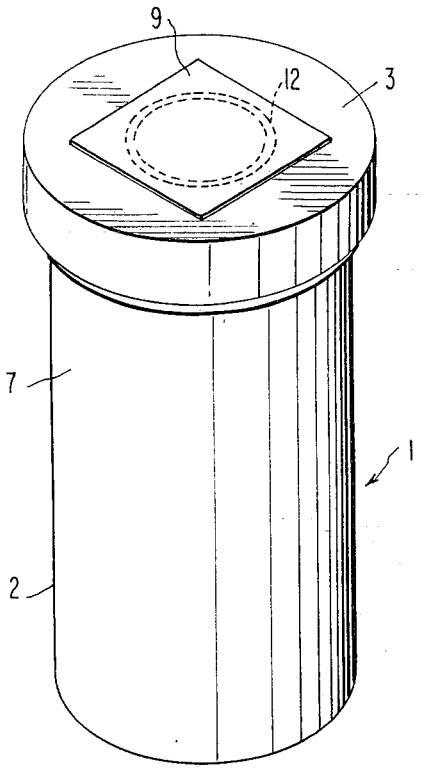
FIG. 1 is an overall isometric view of the container of the present invention.

The present invention is based, primarily, upon three discoveries. The first discovery is that in mixing many components, prior art containers were constructed in such a manner that caking, balling and like agglomeration were significantly prevalent in mixing a solid component from an upper container to a liquid component of a lower container. It was discovered that this agglomeration is primarily a result of the solid component falling only by gravity into the lower liquid component and this gravitational fall essentially piled the solid component in a very small area of the lower mixing container, which allowed for such agglomeration and avoided good dispersion of the solid component into the lower component.

A second basic discovery is that it is possible to improve the mixing of the upper solid component into the lower liquid component by the relatively simple mechanical expedience wherein a momentum is imparted to the upper solid component in opening the upper compartment and causing the solid particle with that momentum to impinge upon a surface which deflects those particles and more uniformly disperses the particles into the lower liquid component.

Finally, the invention is based on the discovery that for many mixings, gases are formed and that adequate mixing can be achieved only by venting of the compartment in a manner which allows automatic, positive and inexpensive venting. Further, venting must be in such a manner that so as to permit subsequent opening of the container without danger to the user and to prevent accidential spills and the like.

With these basic discoveries, the present container was devised. The present container may be characterized as a two-compartment container suitable for more uniformly dispersing the contents of an upper compartment into the contents of a lower mixing compartment. The lower mixing compartment has a bottom, side walls, and an open top and a volume capable of receiving and mixing the contents of both the upper and lower compartments. A closure means is provided for closing the open top of the lower compartment in a liquid-tight manner. The upper compartment has an upper end disposed in the closure means and communicating with an aperture in the closure means. The upper compartment has side walls projecting from the closure means into the lower compartment and an opened lower end disposed in the lower compartment. A lower slideable seal means contacts a perimeter wall portion of the upper compartment near the lower end thereof for effecting a liquid-tight seal (or closure) between the upper compartment and the lower compartment. The lower seals means is exitable from the lower end of the upper compartment. A mechanical linking means is connected to the lower seal means and extends through the upper compartment and into the aperture of the closure means for mechanically transmitting a downwardly, digitally powered movement to the lower slideable seal means. This downward movement is sufficient in length to exit that seal means out of the lower end of the upper compartment, but not sufficient in length to allow the linking means or the lower seal means to fall out of the upper compartment and into the lower compartment. As can be appreciated, this avoids a component of the container falling into the mixed components and aesthetically or functionally interferring with the mixed components.

An upper slideable seal means is disposed around the linking means and contacts a perimeter wall portion of the upper compartment near the upper end thereof. This seal means also functions as an upper closure and, as described in the preferred embodiment, as a selective filter. Thus, a chamber for holding the contents of the upper compartment is formed between the lower and upper seal means and the walls of the upper compartment.

By the foregoing arrangement, the linking means may be quickly, digitally depressed, the lower seals means quickly exits from the lower end of the upper compartment, the contents of the chamber of the upper compartment quickly project therefrom, and at least in part, impinge upon and deflect from the lower seal means, whereby the contents of the upper compartment are more uniformly dispersed into the contents of the lower compartment.

As important but subsidiary features of the invention, there is provided a positive stop means for abruptly stopping the downward movement of the mechanical linking means and, hence, the lower seal means, whereby the contents projected from the chamber will abruptly impinge upon the lower seal means and be further deflected therefrom to improve the uniformity of dispersion and to positively avoid the linking means or upper or lower seals means from falling into the lower compartment.

As a further subsidiary but very important feature of the invention, the upper seal means is impervious to solids contained in the upper chamber, but is pervious to gases, whereby a gas vent to the atmosphere is automatically formed from the lower mixing compartment through the opened lower end of the upper compartment, the upper chamber, the gas previous upper seal and the aperture in the closure means. This vent will automatically form when the lower seals has exited the lower end of the upper compartment and, accordingly, is essentially fool-proof and inexpensive to manufacture.

DETAILED DESCRIPTION OF THE INVENTION

From the above, it will be appreciated that the invention is based upon not only the particular mechanical configurations of the individual elements, but the cooperation and co-action therebetween, whereby the interrelated functions result in advantages not achievable by individual operation of the individual elements. Hence, the interrelating functions performed by the elements are to be considered as additional description of the elements themselves, and the following disclosure and claims should be so construced.

It will also be appreciated from the above that the materials of construction of the present container may be chosen from a wide variety of materials, including plastics, such as polyethylene, polyproplyene, polycarbonate, polystyrene, ABS terpolymers, phenolics and the like. Alternatively, the containers may be made of metals, or glass, or even ceramics. The preferred materials of construction are plastics, particularly polyofins such polyethylene or polyproplyene, since these may be conveniently injection molded, will substain required pressures, and are generally inert to most mixed components.

As can be seen from FIG. 1, the present container, in assembled form, generally 1, is comprised of a lower mixing compartment 2 and a closure means 3. As best seen from FIG. 2, closure means 3 is attached to lower compartment 2 by any convenient device, such as the illustrated male threads 4 of the lower compartment and female threads 5 of the closure means. Arrangements other than the illustrated screw-type thread may be used, such as the conventional bayonet-type thread, inclined dogs, rupturable seals, friction fits and the like.

Figure 2:
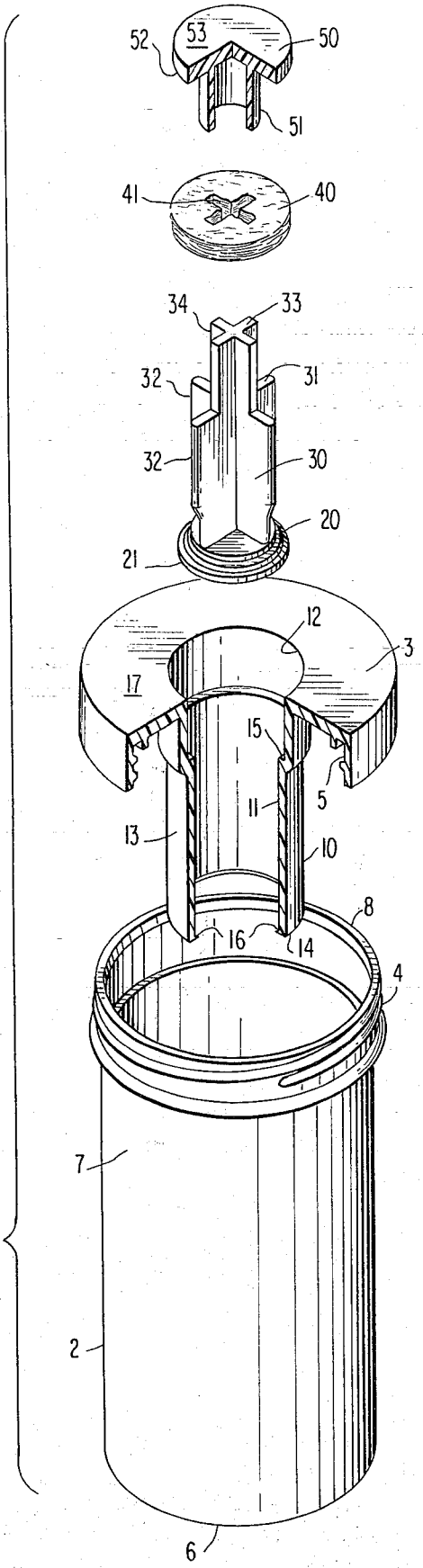
FIG. 2 is an exploded view of the container of FIG. 1 showing the elements, partly cut away, of a preferred form of the container.

As can also be seen from FIG. 2, the container is preferably comprised of several main parts. Thus, there is the lower mixing compartment 2, having a bottom 6 and side walls 7 and an open top 8. The volume of lower compartment is such that it is capable of receiving and mixing the contents of the lower compartment 2 and the contents of upper compartment 10.

Closure means 3 for closing the open top 8 of lower compartment 2 effects closure in a liquid-tight manner and also disposes upper compartment 10 inside of lower compartment 2. Upper compartment 10 has an upper end 11 disposed in closure means 3 and communicates with an aperture 12, in closure means 3. The upper compartment also has side walls 13 projecting from closure means 3 into the lower compartment 2, as well as an open lower end 14 disposed in the lower compartment.

A lower slideable seal means 20 is configured to contact a perimeter wall portion (inside wall portion) of the upper compartment 10 near the lower end 14 thereof, for effecting a liquid-tight seal between the upper compartment 10 and lower compartment 2. This lower seal means is exitable from lower end 14 of upper compartment 10. A mechanical linking means 30 connects the lower seal means 20 and, when fully disposed in lower compartment 10, extends through upper compartment 10, and into aperture 12 of closure means 3. Thus, the linking means provides for mechanically transmitting a downwardly, digitally powered movement to the lower slideable seal means 20. That downward movement will be sufficient in length to cause that seal means to exit out of lower end 14 of upper compartment 10 but not sufficient in length to allow the linking means or lower seal means to fall out of the upper compartment and into the lower compartment.

Figure 7:
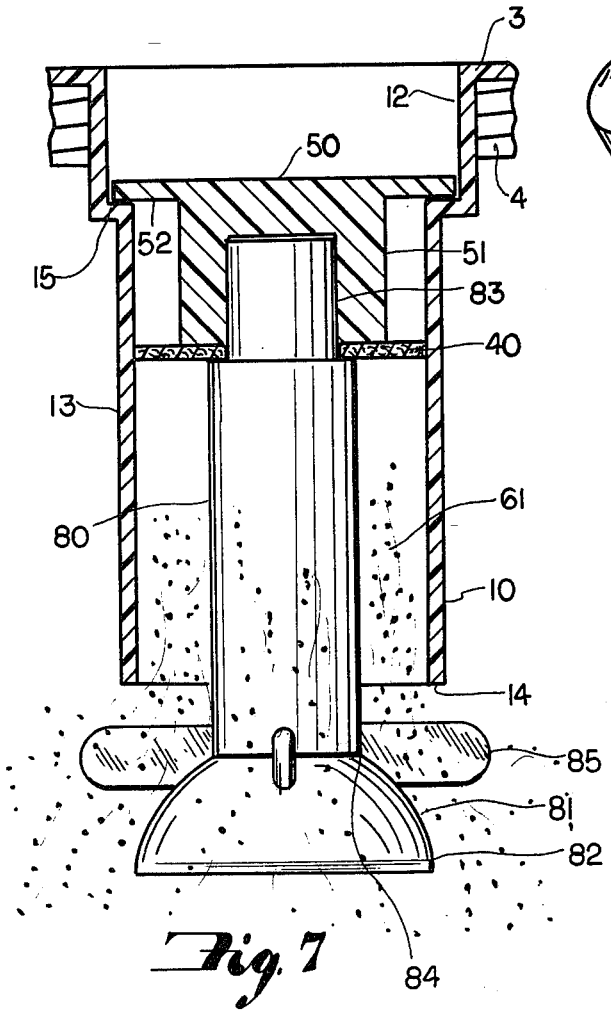
FIG. 7 is a side view, partly in cross-section, of an alternative arrangement of the upper compartment, linking means, lower seal means, skirt and upper seal means.

The linking means 30 may be of any desired configuration, including oval, circular, rectangular, squared, or sectioned cross-sections, but the simply x cross-section of FIG. 1 or circular cross-section of FIG. 7 are quite acceptable. The x-cross-section provides protuberances 32 which are radially disposed therefrom and contact side walls 13 to provide a stable movement of linking means 30 into and through upper compartment 10.

An upper slideable seal means 40 is configured to be disposed around the linking means 30 and will also contact a perimeter wall portion of the upper compartment near the upper end 11 thereof. Thus, an upper chamber for holding the content of the upper compartment is formed between the lower seal means 20 and the upper seal means 40, and the walls (side walls) of the upper compartment.

While not required, it is preferred that the uppermost portion 33 of linking means 30 have a flange portion 50 either attached or attachable thereto (shown attachable thereto in FIG. 2) of a size for comfortably asserting digital pressure on the linking means. That flange portion 50 should be capable of passing through aperture 12 and closure means 3, and into or near upper compartment 10 to provide the required downward movement of the linking means. However, that flange portion should not be capable of passing through upper compartment 10. To this end, preferably, a shoulder means 15 is provided at the upper end of the upper compartment. This shoulder means has a configuration such that it will not allow the passing of flange portion 50 therethrough and, hence, a positive stop of the downward movement of the linking means is thus provided.

In one form of the present invention, the protuberances 32 provide mechanical centering of the linking means in the upper compartment and flange portion 50 may be frictionally fitted onto the linking means by means of a friction fit receiving means 51, co-acting with a reduced portion 34 of linking means 30 such that the outside dimension of friction fit receiving means 51 are essentially compatible with the outside dimensions of protruberances 32. This will ensure the mechanical centering function of the protruberances and allow friction fit receiving means 51 to partially pass into upper compartment 10.

Upper seal means 40 has an appropriately configured seal aperture 41 so that the upper seal means may be slipped over reduced portion 34 and abutt the protruberances at or near 31, and held by receiving means 51.

As can be appreciated, upper seal means 40 may be either pervious or impervious. Accordingly, the upper compartment may contain a solid or it may contain a liquid. In the event that it contains a liquid, the upper seal means must be impervious to passage of the liquid. On the other hand, where the upper compartment will contain a solid, which is the preferred embodiment, the upper seal means need not be liquid-tight and need only be sufficient to retain the solids in the chamber formed between the upper and lower seal means. Further, in a preferred embodiment of the invention, the upper seal means is impervious to solids contained in the chamber, but pervious to gases, whereby a gas vent to the atmosphere is formed from the lower mixing compartment 2, through the opened end 14 of lower compartment 10, the upper chamber (formed in the upper compartment between the two sealed means), the gas pervious upper seal 40 and the aperture 12 of closure means 3. This, of course, occurs when lower seal means 20 has exited the lower end 14 of upper compartment 10. In this preferred embodiment, upper seal means 40 is made of a gas pervious material such as a textile, e.g., woven, nonwoven, felted and the like. or it may be made of gas pervious wood fiber products, e.g., pressed fiber papers, or it may be made gas pervious plastics, e.g., open cell plastic foam such as polyurethane foam or polystyrene foam. Suitably, the seal means is of a textile sufficiently thick that gases passing therethrough are muffled in sound and more preferably of such a thickness as to remove entrained liquids in the gases.

From the above, it can be appreciated that when linking means 30 is quickly digitally depressed, preferably by digital pressure on flange portion 50, the lower seal means 20 will quickly exit from the lower end of upper compartment 10. Thus, the contents in the chamber of the upper compartment will quickly project from the upper compartment, and at least in part, impinge upon and deflect from lower seal means 20, whereby the contents of the upper compartment are spread outwardly, somewhat in the manner of an umbrella-like dispersion, and will fall into the upper compartment. With this umbrella-like dispersion, a more uniform dispersion of the contents of the upper compartment into the lower compartment will be achieved.

From the foregoing, it can be appreciated that it is of considerable importance that the mechanical linking means be quickly digitally depressed by a downwardly digitally powered movement. If the linking means were depressed by a mechanical movement, e.g. screw action, as opposed to digital movement, the upper compartment would be relatively slowly opened and the contents of the upper compartment would not quickly project from the upper compartment and impinge upon and deflect from the lower seal means. Thus, the present umbrella-like dispersion of the contents of the upper compartment would not be achieved. In this regard, the term "direct downwardly digitally powered movement" of the linking means is defined in the ordinary sense, i.e., the movement is achieved by direct digital (finger or thumb) contact and pressure on the linking means. Of course, as noted above, this direct digital contact and pressure on the linking means is preferably achieved by contact and pressure on flange 50, which, as noted above, provides finger comfort in asserting the digital pressure on the linking means.

This desired dispersion occasioned by impingment of the contents of the upper compartment on to seal means 20 is most advantageously accentuated when there is provided a positive stop means for abruptly stopping the downward movement of the mechanical linking means and, hence, the lower seal means. By this arrangement, the contents projecting from the chamber will abruptly impinge upon the lower seal means and be further deflected therefrom to improve the uniformity of the dispersion of the contents of the chamber into the lower mixing compartment. Further, this positive stop means will positively avoid the linking means or either of the seal means from falling into the lower compartment. This positive stop is provided by the combination of shoulder 15 abruptly stopping the movement of flange portion 50 when the under surface 52 of flange portion 50 abruptly hits shoulder 15. Of course, other positive stop arrangements may be provided, but this positive stop arrangement is simple to construct and most effective in operation. A further improvement in this dispersion is provided by the arrangement of FIGS. 7 and 8, explained hereinafter.

Lower seal means 20, preferably, is a skirted seal means which has a downwardly disposed angular, flexible skirt 21 associated therewith, the dimensions of which are slightly greater than the dimensions of the corresponding inside dimension of the side walls of the upper compartment. Thus, the skirt 21 is slightly depressed inwardly when the seal is disposed in the upper compartment and, further, effects a slideable, liquid-tight seal. As shown in FIG. 2, the side walls of the upper compartment are in cylinderical form, the preferred form of the invention, and correspondingly the lower seal and skirt are in circular form.

With the arrangement of the skirt seal, described above, a further advantageous feature of the invention is easily provided. Thus, a detent means is provided wherein the initial digital power required to commence movement of linking means 30 is greater than the digital power required to continue movement of the linking means (considering the sliding friction of the seal means), whereby accidential discharge of the contents of the upper compartment into the lower compartment is mitigated. A very effective way of providing the detent means is to provide an inwardly disposed lip 16 at the open lower end 14 of upper compartment 10. Thus, in order to commence movement of the linking means and, hence, exit the seal means out of open end 14, skirt 21 must be passed through lip 16 which increases the digital pressure for commencing the movement of the linking means. Once pass lip 16, however, the digital pressure required for further movement of the linking means is dependent upon the friction between protruberances 32 and the inside walls of upper compartment 10.

To mitigate the possibility of accidential discharge of the contents of the upper compartment, the uppermost surface 53 of the flange portion 50 (or the linking means) will not protrube above the uppermost surface 17 of closure means 3 near aperture 12. With the flat area of the uppermost surface of the closure means, the containers are stackable, packageable in conventional fibrous boxes and provide a pleasing appearance.

Further, to mitigate accidential discharge of the contents of the upper compartment and to also avoid ambient contamination, a strippable tape 9 is applied over aperture 12.

Figure 3:
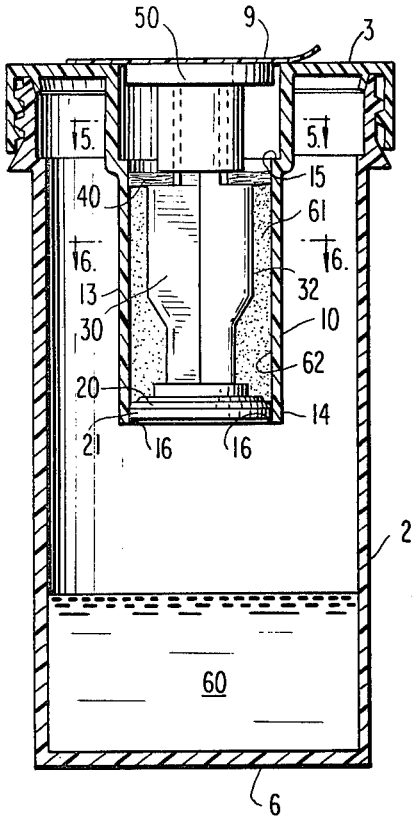
FIG. 3 is a cross-sectional view of the container showing materials packaged therein with material in both the upper compartment and the lower compartment.
Figure 4:
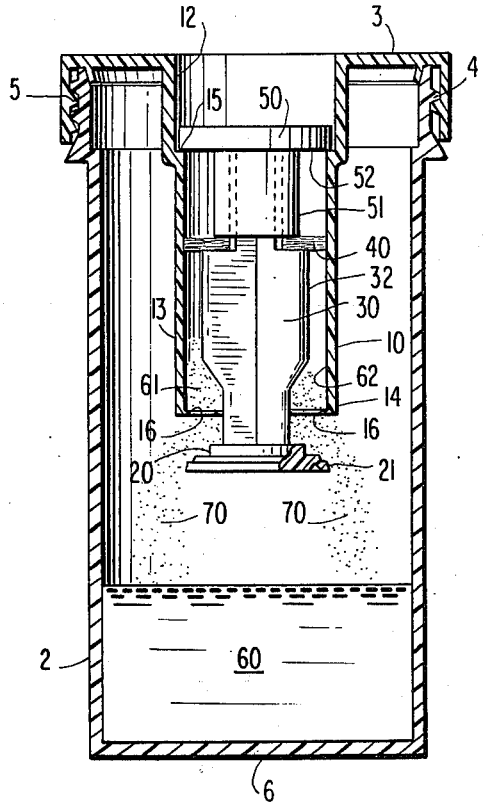
FIG. 4 is a cross-sectional view of the container and packaged materials of FIG. 3 where the upper compartment has been opened and the contents of the upper compartment are discharged into the contents of the lower compartment.
Figure 5:
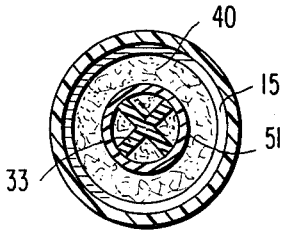
FIG. 5 is a sectional view along lines 5—5.
Figure 6:
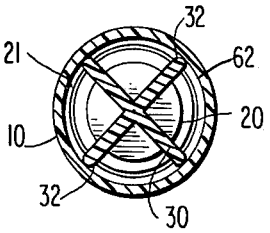
FIG. 6 is a sectional view along lines 6—6.

As noted above, it is the cooperation and resulting functions of the individual elements which form the major features of the invention. FIGS. 3 and 4 show how these elements function to provide these improved results. In FIG. 3, lower mixing compartment 2 contains a liquid component 60 and upper compartment 10 has disposed in the chamber formed between lower seal means 20 and upper seal means 40 a solid component 61. To operate the container and to mix the liquid and solid components 60 and 61, tape 9 is removed from closure 3 which exploses flange portion 50 for digital operation. By digitally pressing downwardly flange portion 50, mechanical linking means 30 transmits that force to seal means 20 and with sufficient force, skirt 21 projects past lip 16 and exits lower end 14 of upper compartment 10.

With further digital pressure on flange portion 50, the sliding friction between protruberances 32 and the inside wall 62 of upper compartment 10 allows travel of the linking means downwardy and opens lower end 14 of compartment 10 as shown in FIG. 4. Since the detent requires substantial pressure to overcome, once that detent is overcome the residual digital pressure very quickly moves lower seal means out of compartment 10 and upper seal means 40 quickly forces the solid component in the chamber in upper compartment 10 downwardly. This imparts substantial velocity and momentum to the components and those components projecting from the chamber will abruptly impinge upon lower seal means 20 and be deflected therefrom as shown at 70 of FIG. 4, forming a somewhat umbrella-shaped dispersion.

Further, when the under surface 52 of flange portion 50 engages shoulder 15, movement of seal 20 comes to an abrupt halt and the momentum and the velocity of the component being discharged from compartment 20 will cause greater impact upon stopped seal 20 and greater dispersion of that component.

It will also be appreciated that since closure 3 is sealed to lower compartment 2 by virtue of threads 4 and 5, a liquid-tight seal is provided. Thus, when the components 61 of upper compartment 10 form a gas when mixed with the components 60 of lower compartment 2, the container would become pressurized and, possibly, explode if not vented. This is particularly true when the gas forms a foam of the mixed components. With the present arrangement, a vent of that nature may be automatically made since communication with the atmosphere will be through open end 14 of upper compartment 10, the chamber (between lower seal means 20 and upper seal means 40), seal means 40, past protruberances 32, and out of the container via aperture 12. If desired, though not really necessary, preforations through flange portion 50 or vertical abuttments on shoulder 15 may ensure that under surface 52 of flange portion 50 does not form a seal with shoulder 15. Normally, however, there is sufficient clearance that pressure is adequately released without any special provisions.

For purposes of venting, as can be appreciated from the foregoing, upper seal 40 must be previous to gas but should be impervious to entrained liquid, such as the liquid entrained in a foam, so that an unsightly and undesired exit of liquid will not occur through aperture 12. Additionally, this kind of upper seal means will allow the contents of the two compartments to be better mixed by shaking, revolving, or otherwise agitating the container with the two components mixed in the lower compartment.

Normally, after mixing, the contents are removed by unscrewing closure 3 from lower compartment 2. With the removal of closure 3, the upper compartment is also removed and no portion thereof will be contained in the lower compartment, as was the case in prior art approaches. Thus, the lower compartment could be used as a drinking glass, as a decorative container, or in any event will not detract from the utility and aesthetic appeal of the mixed components.

However, if desired, closure 3 may be provided with any desired means of removing the mixed contents without removing closure 3, such as a threaded plug through closure 3 (not shown), a tube leading therefrom which may be opened by tearing, cutting and the like (not shown), and other similar means for removing the mixed contents from the lower compartment. Other caps and closures of this nature will be readily apparent to those skilled in the art.

Figure 8:
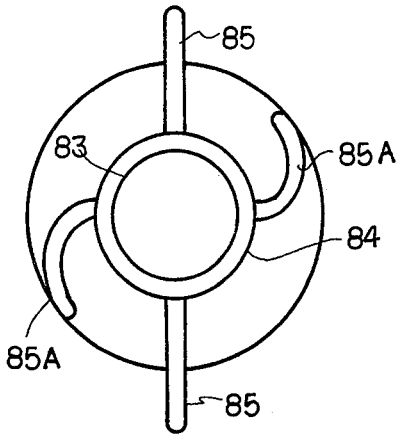
FIGS. 8 and 9 are top views of the lower seal means, skirt, and linking means of FIG. 7 wherein bendable protuberances are illustrated.

A further embodiment of an arrangement of the upper compartment linking means, lower seal means, skirt and upper seal means is shown in FIG. 7. FIG. 8 is a top view of the lower seal means, skirt and linking means of FIG. 7. The portion of FIG. 7 shown in cross-hatching is the same arrangement of FIGS. 2, 3 and 4. However, in the embodiment of FIG. 7, the linking means 80 is of regular cross-section, rather than the X-cross-section illustrated in FIGS. 2 through 6. In FIG. 7, the cross-section is circular and may be in either solid or hollow form, i.e. the interior of the linking means may be annular in cross-section. Similar to the arrangement shown in FIGS. 2 through 6, the linking means has a lower slidable seal means 81, and a flexible skirt means 82. The flexible skirt means is slightly compressed within side walls 13 of upper compartment 10 so that it provides a seal of the upper compartment at lower open end 14 of upper compartment 10, in the same manner described above in connection with the embodiment illustrated in FIGS. 1 through 6. Also, as in that earlier described embodiment, there is a reduced portion 83 which frictionally fits with friction fit receiving means 51 whereby flange portion 50 is snugly held to the linking means. Flange portion 50 is free to snugly move in and out of aperture 12 and will cease downward movement when upper surface 52 engages shoulder means 15, the position shown in FIG. 7.

As will be appreciated, there are several differences between the embodiment of FIG. 7 and the embodiment of FIGS. 2 through 6. Thus, upper slidable seal means 40 is simply held between friction fit receiving means 51 and any solid component 61 which may be packed into upper compartment 10. Additionally, there are no protuberances, such as protuberances 32, in the embodiment of FIG. 7, and the centering of the linking means and lower slidable seal means is accomplished by upper flange portion 50 sliding within aperture 12. Thus, this is a simpler arrangement than that of FIGS. 2 through 6, but is still quite acceptable for many uses.

FIG. 7, and particularly FIG. 8, shows a further embodiment of the invention. This embodiment is shown in connection with the arrangement of linking means 80 of FIG. 7, but it is applicable to any linking means according to the invention.

Figure 9:
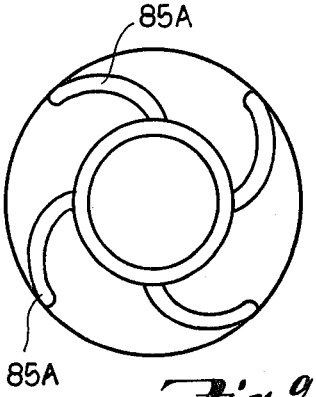
Figure 10:
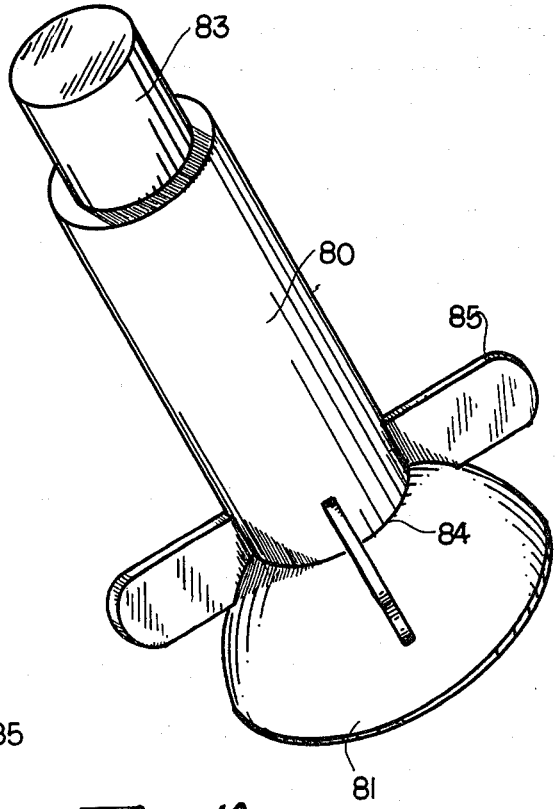
FIG. 10 is a prespective view of the lower seal means, skirt, linking means and protuberances of FIGS. 8 and 9.

Thus, at and/or near junction 84, i.e. the juncture between the linking means 80 and the lower slidable seal means 81, is disposed a flexible and bendable protuberance 85. A plurality, e.g. 1–10, bendable protuberances may be deployed, and four are shown. FIG. 8 shows protuberances 85A, in the bent position when contained inside upper compartment 10 (also see FIG. 9 in this regard), and protuberances 85 in the extended position after exiting lower open end 14 (also see FIG. 10 in this regard).

As can be easily appreciated, therefore, when protuberances 85 exit lower open end 14, they produce a lateral motion due to the flexible nature of the material and impart a radial force to solid component 61 which, substantially increases the uniformity of dispersion of the solid component as it falls into the liquid component 60 in the bottom compartment 2. The flexible and bendable protuberances may be of any desired shape and material, so long as they are sufficiently flexible to be folded within compartment 10, and automatically spring out when exiting from lower open end 14. Quite suitably the plastics and materials disclosed above in connection with FIGS. 2 through 6 may be used for the protuberances; indeed linking means 80, lower slidable seal means 81 and protuberances 85 may all be molded as a monolithic unit.

Accordingly, it can be understood that in this embodiment, the lower slidable seal means has at least one of the defined bendable and flexible protuberances associated therewith, and the bendable and flexible protuberances are of dimensions greater than the dimension of the lower end of the lower compartment, whereby the protuberance is in a flexed and bent configuration while disposed within the upper compartment, but automatically flexes to an unbent configuration when exiting from the lower end of the upper compartment. This provides a further force to the contents of the upper compartment, and improves the dispersion of those contents in the contents of the lower compartment.

Thus, the objects of the invention are achieved. It will be appreciated, however, that modifications and variations of the specific foregoing embodiments will be readily apparent to the art and the invention extends to the spirit and scope of the annexed claims.

What is claimed is:

1. A two-compartment container suitable for more uniformly dispersing solid components in an upper compartment into liquid contents of a lower mixing compartment comprising:

(a) a lower mixing compartment having a bottom, side walls and an open top and having a volume capable of receiving and mixing the contents of the upper and lower compartments;

(b) a closure means for closing the open top of the lower compartment in a liquid-tight manner;

(c) an upper compartment having an upper end disposed in the closure means and communicating with an aperture in the closure means, side walls projecting from the closure means into the lower compartment, and an open lower end disposed in the lower compartment;

(d) a lower flexible and slidable seal means having a downwardly disposed angular flexible skirt contacting a perimeter side wall portion of the upper compartment near the lower end thereof, said skirt having dimensions which are slightly greater than the dimensions of the corresponding inside dimension of the sidewalls of the upper compartment, whereby the skirt is slightly compressed inwardly when the seal is disposed in the upper compartment to effect a slidable liquid-tight seal between the upper compartment and the lower compartment, and said lower seal means being exitable from the open lower end of the upper compartment;

(e) a mechanical linking means connected to the lower seal means and extending through the upper compartment and into the aperture in the closure means for mechanically transmitting a direct downwardly digitally powered movement to the lower slidable seal means, said downward movement being sufficient in length to exit that seal means out of the lower end of the upper compartment but not sufficient in length to allow the linking means or lower seal means to fall out of the upper compartment and into the lower compartment;

(f) an upper slidable seal means disposed around the said linking means and contacting a perimeter side wall portion of the upper compartment near the upper end thereof, whereby an upper chamber for holding the contents of the upper compartment is formed between said lower and said upper seal means and the walls of the upper compartment; and (g) a positive stop means for abruptly stopping the downward movement of the mechanical linking means and, hence, the lower seal means;

wherein the linking means may be quickly and directly digitally depressed, the lower seal means quickly exits from the lower end of the upper compartment, the contents in the chamber of the upper compartment quickly project from, and at least in part, abruptly impinge upon and deflect from the lower seal means and skirt, whereby the contents of the upper compartment are more uniformly dispersed into the contents of the lower compartment.

2. The container of claim 1 wherein the linking means has protuberances radially disposed thereon which contact the sidewalls of the upper compartment.

3. The container of claim 2 wherein the protuberances provide mechanical centering of the linking means in the upper compartment.

4. The container of claim 1 wherein the sidewalls of the upper compartment are in cylindrical form and the lower seal and skirt are in circular form.

5. The container of claim 1 wherein the upper seal means is impervious to solids contained in the said chamber, but is pervious to gases, whereby a gas vent to the atmosphere is formed from the lower mixing compartment, through the opened lower end of the upper compartment, the upper chamber, gas pervious upper seal means and the aperture in the closure means, when the lower seal means has exited the lower end of the upper compartment.

6. The container of claim 5 wherein the upper seal means is of sufficient thickness that gases passing therethrough are muffled in sound.

7. The container of claim 1 wherein the uppermost portion of the linking means has a flanged portion of a size for comfortably exerting digital pressure thereon, which flanged portion is capable of passing through the aperture in the closure means and into the upper compartment to provide the required downward movement of the linking means, but said flanged portion is not capable of passing through a shoulder means in the upper compartment, whereby a positive stop is provided.

8. The container of claim 1 wherein a detent means is provided wherein the initial digital power required to commence movement of the linking means is greater than the digital power required to continue movement of the linking means, whereby accidental discharge of the contents of the upper compartment into the lower compartment is mitigated.

9. The container of claim 8 wherein the detent means is an inwardly disposed lip at the open lower end of the upper compartment.

10. The container of claim 1 wherein the uppermost portion of the linking means does not protrude above the uppermost plane of the aperture in the closure means, whereby accidental discharge of the contents of the upper compartment is mitigated, the containers are stackable, packageable in conventional fibrous boxes and provide a pleasing appearance.

11. The container of claim 10 wherein a strippable tape is applied over the aperture in the closure means and the uppermost portion of the linking means to avoid ambient contamination and mitigate accidental discharge of the contents of the upper compartment.

12. The container of claim 1 wherein the lower container is a conventional screw-type or bayonet-type threaded bottle or cylinder and the closure means attaches thereto by a corresponding thread.

13. The container of claim 1 wherein the lower slidable seal means has at least one bendable and flexible protuberance associated therewith, said bendable and flexible protuberance being of dimensions greater than the dimension of the lower end of the lower compartment whereby the said protuberance is in a flexed and bent configuration while disposed within the upper compartment but automatically flexes to an unbent configuration when exiting from the lower end of the upper compartment to provide a further force to the contents of the upper compartment and improve the dispersion thereof in the contents of the lower compartment.

14. The container of claim 1 wherein the closure, upper compartment and lower compartment are made of a plastics material.

* * * * *